US008967794B2

(12) United States Patent
Hayashi

(10) Patent No.: US 8,967,794 B2
(45) Date of Patent: Mar. 3, 2015

(54) LIQUID EJECTING APPARATUS

(71) Applicant: Seiko Epson Corporation, Tokyo (JP)

(72) Inventor: Seiya Hayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/043,504

(22) Filed: Oct. 1, 2013

(65) Prior Publication Data

US 2014/0092193 A1 Apr. 3, 2014

(30) Foreign Application Priority Data

Oct. 3, 2012 (JP) ..... 2012-220989

(51) Int. Cl.

| | |
|---|---|
| ***B41J 2/01*** | (2006.01) |
| ***B41J 29/17*** | (2006.01) |
| ***B41J 29/02*** | (2006.01) |
| ***B41J 29/13*** | (2006.01) |

(52) U.S. Cl.

CPC *B41J 29/17* (2013.01); *B41J 29/02* (2013.01); *B41J 29/13* (2013.01)

USPC ..... 347/104; 347/101

(58) Field of Classification Search

CPC ..... B41J 11/007; B41J 11/06; B41J 11/0085; B41J 13/103; B41J 11/0065

USPC ..... 347/104, 101

See application file for complete search history.

(56) References Cited

U.S. PATENT DOCUMENTS

| | | | | |
|---|---|---|---|---|
| 5,155,525 | A * | 10/1992 | Jones et al. | 355/132 |
| 5,179,416 | A * | 1/1993 | Ku et al. | 399/343 |
| 6,219,505 | B1 | 4/2001 | Sato et al. | |
| 2006/0188306 | A1 * | 8/2006 | Fukuta | 399/390 |
| 2007/0146456 | A1 * | 6/2007 | Tanabe | 347/101 |
| 2010/0165368 | A1 * | 7/2010 | Matsuoka | 358/1.9 |
| 2011/0277652 | A1 * | 11/2011 | Cyr et al. | 101/425 |
| 2012/0087704 | A1 * | 4/2012 | Asaoka et al. | 399/350 |

FOREIGN PATENT DOCUMENTS

| | | |
|---|---|---|
| JP | 07-309045 | 11/1995 |
| JP | 2000-206850 | 7/2000 |
| JP | 2001-171208 | 6/2001 |

* cited by examiner

*Primary Examiner* — Manish S Shah
*Assistant Examiner* — Yaovi Ameh
(74) *Attorney, Agent, or Firm* — Workman Nydegger

(57) ABSTRACT

A liquid ejecting apparatus includes a liquid ejecting unit that ejects ink onto paper, a first removal roller that rotates in a direction opposite to a transportation direction of the paper at a first contact position in a state of being contact with a first surface of the paper that is transported at the first contact position so as to remove adhering objects which have adhered to the paper, and a second removal roller that rotates in a direction opposite to the transportation direction of the paper at a second contact position in a state of being contact with a second surface of the paper that is transported at the second contact position so as to remove adhering objects which have adhered to the paper.

8 Claims, 4 Drawing Sheets

LIQUID EJECTING APPARATUS

BACKGROUND

1. Technical Field

The present invention relates to a liquid ejecting apparatus that ejects liquid onto a medium such as paper.

2. Related Art

As an existing liquid ejecting apparatus that ejects liquid onto a medium, there is an ink jet printer (hereinafter, simply referred to as a "printer") that ejects ink onto paper so as to perform printing.

In the printer, if adhering objects such as dusts adhere to the paper, the adhering objects make contact with nozzles for ejecting liquid and so on, resulting in lowering of print quality in some cases. Therefore, a non-woven fabric for wiping the adhering objects away or a removal member formed with a rubber or the like to which adhering objects are adsorbed is provided at a position at which the non-woven fabric or the removal member is capable of making contact with a printing surface of the paper in some cases (for example, JP-A-2001-171208).

Paper powder generated when paper is cut into a predetermined size adheres to end portions of the paper in many cases. Since a particle diameter of the paper powder is extremely small, the paper powder cannot be removed completely only by making the non-woven fabric slide contact with the paper. Further, since much paper powder adheres to the end portions of the paper, there is a problem that the paper powder cannot be removed completely only by making the removal member contact with the printing surface of the paper.

The problem arises substantially commonly not only on the printer that ejects ink onto the paper but also on liquid ejecting apparatuses that eject liquids onto a medium.

SUMMARY

An advantage of some aspects of the invention is to provide a liquid ejecting apparatus capable of removing adhering objects that have adhered to end portions and the like of a medium onto which liquid is ejected.

Hereinafter, methods for achieving the above-mentioned object and action effects thereof are described.

A liquid ejecting apparatus according to an aspect of the invention includes a liquid ejecting unit that ejects liquid onto a medium, a first removal roller as a removal roller that rotates in a direction opposite to a transportation direction of the medium at a first contact position in a state of being contact with a first surface of the medium that is transported at the first contact position so as to remove adhering objects which have adhered to the medium, and a second removal roller as a removal roller that rotates in the direction opposite to the transportation direction of the medium at a second contact position in a state of being contact with a second surface of the medium that is transported at the second contact position so as to remove adhering objects which have adhered to the medium.

With the configuration, the removal rollers rotate in the rotating direction opposite to the transportation direction while making contact with the medium so as to remove the adhering objects which have adhered to the medium in a scraping manner effectively. Further, the first removal roller makes contact with the first surface of the medium, whereas the second removal roller makes contact with the second surface of the medium. Therefore, the adhering objects that have adhered to the end portions of the medium can be removed effectively. Accordingly, the adhering objects that have adhered to the end portions and the like of the medium onto which liquid is ejected can be removed.

In the liquid ejecting apparatus according to the above-mentioned aspect of the invention, it is preferable that the first contact position and the second position be separated from each other in the transportation direction.

If two removal rollers rotate in a state of pinching the medium, there arise risks that transportation of the medium is inhibited and the medium is wrapped around the removal rollers. However, with the configuration, the first contact position and the second contact position are separated from each other in the transportation direction of the medium so as to reduce the above-mentioned risks.

It is preferable that the liquid ejecting apparatus according to the above-mentioned aspect of the invention further include a removal member that makes contact with an outer circumferential surface of the removal roller so as to remove adhering objects which have adhered to the outer circumferential surface.

With the configuration, the adhering objects which have adhered to the removal roller are removed by the removal member. This suppress problems that removal capability of the removal roller is lowered and the adhering objects which have adhered to the removal roller join together and adhere to the medium.

In the liquid ejecting apparatus according to the above-mentioned aspect of the invention, it is preferable that the medium be transported in a state where the first surface onto which liquid is ejected faces downward at the first contact position and the first removal roller be arranged at a lower side of a transportation path of the medium, and the removal member be arranged at a downstream side with respect to the first removal roller in the transportation direction.

With the configuration, the medium is transported in a state where the first surface faces downward at the first contact position and the removal member is arranged at the downstream side with respect to the first removal roller in the transportation direction. Therefore, adherence of the adhering objects that have been removed from the first removal roller to the medium and the second removal roller can be suppressed.

In the liquid ejecting apparatus according to the above-mentioned aspect of the invention, it is preferable that a receptacle unit for receiving adhering objects removed from the medium be provided at a lower side of the removal roller.

With this configuration, the adhering objects that have been removed from the medium are held on the receptacle unit. Therefore, scattering of the adhering objects removed from the medium to the periphery can be suppressed.

It is preferable that the liquid ejecting apparatus according to the above-mentioned aspect of the invention further include driving rollers for transporting the medium, and a driving source for rotating the removal rollers and the driving roller.

With this configuration, the removal rollers rotate with a driving force from a driving source same as the driving rollers. Therefore, another driving source for rotating the removal rollers is not needed to be provided.

In the liquid ejecting apparatus according to the above-mentioned aspect of the invention, it is preferable that one driving roller be provided at a position at an upstream side with respect to the first contact position in the transportation direction and another driving roller be provided at a position at a downstream side with respect to the second contact position in the transportation direction, and rotation speeds of the removal rollers be lower than rotation speeds of the driving rollers.

With this configuration, the driving rollers are provided at the position at the upstream side with respect to the first contact position in the transportation direction and the position at the downstream side with respect to the second contact position in the transportation direction. Further, the rotation speeds of the removal rollers are lower than the rotation speeds of the driving rollers. Therefore, even when the removal rollers rotate in the opposite direction to the driving rollers, the paper can be transported in the transportation direction.

In the liquid ejecting apparatus according to the above-mentioned aspect of the invention, it is preferable that at least one of a plurality of removal rollers having different outer diameters be used for the removal roller, and a rotation speed of the removal roller be set to be lower as an outer diameter of the removal roller is larger.

With this configuration, when the outer diameter of the removal roller is small, the rotation speed of the removal roller is made high so as to enhance a scraping effect of the adhering objects. On the other hand, when the rotation speed of the removal roller is low, the outer diameter of the removal roller is made large so as to increase a contact area with the medium. This makes it possible to remove the adhering objects reliably.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting apparatus will be described with reference to the drawings.

Figure 1:
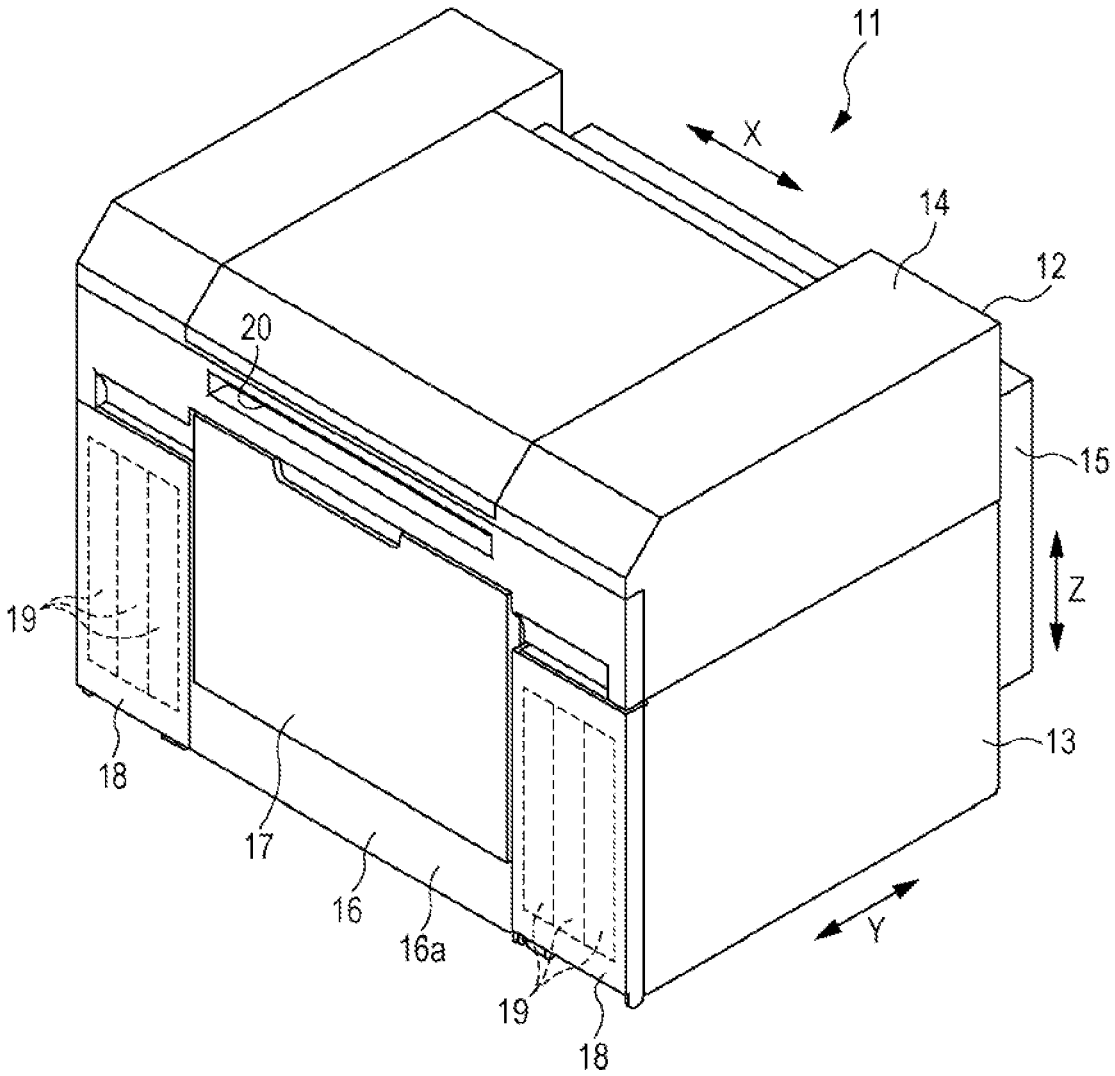
FIG. 1 is a perspective view illustrating a liquid ejecting apparatus according to an embodiment.

As illustrated in FIG. 1, a liquid ejecting apparatus 11 according to this embodiment includes an approximately rectangular box-shaped case body unit 12. The case body unit 12 includes a first housing portion 13, a second housing portion 14 arranged above the first housing portion 13, and a third housing portion 15 arranged at the rear side of the first housing portion 13. Note that in this embodiment, a direction in which the second housing portion 14 and the third housing portion 15 are aligned, which intersects (orthogonally, in this embodiment) with a vertical direction Z along the gravity force direction, corresponds to a depth direction Y. Meanwhile, the lengthwise direction of the first housing portion 13 and the second housing portion 14, which intersects (orthogonally, in this embodiment) with the vertical direction Z and the depth direction Y, corresponds to a width direction X.

A holding frame 16 is housed in the first housing portion 13 so as to be capable of being pulled out therefrom. Furthermore, a front end surface 16*a* of the holding frame 16, a front surface cover 17, and opening/closing covers 18 are exposed at the front surface side of the first housing portion 13. The front surface cover 17 is attached to the upper side of the front end surface 16*a* in a detachable manner. The opening/closing covers 18 are attached to both sides of the holding frame 16 in the width direction X in a rotationally movable manner.

The opening/closing covers 18 can be switched between closed positions as illustrated in FIG. 1 and open positions at which upper end portions of the opening/closing covers 18 are rotationally moved to the front side and the inner portion of the apparatus is exposed if the upper end portions of the opening/closing covers 18 move rotationally about rotational movement shafts (not illustrated) provided at the lower end sides thereof. When the opening/closing covers 18 are arranged at the open positions, cartridge holders (not illustrated) are exposed. Ink cartridges 19 that accommodate ink as an example of liquid are attached to the cartridge holders in a detachable manner. Furthermore, a discharge port 20 is formed at the front surface side of the second housing portion 14.

Figure 2:
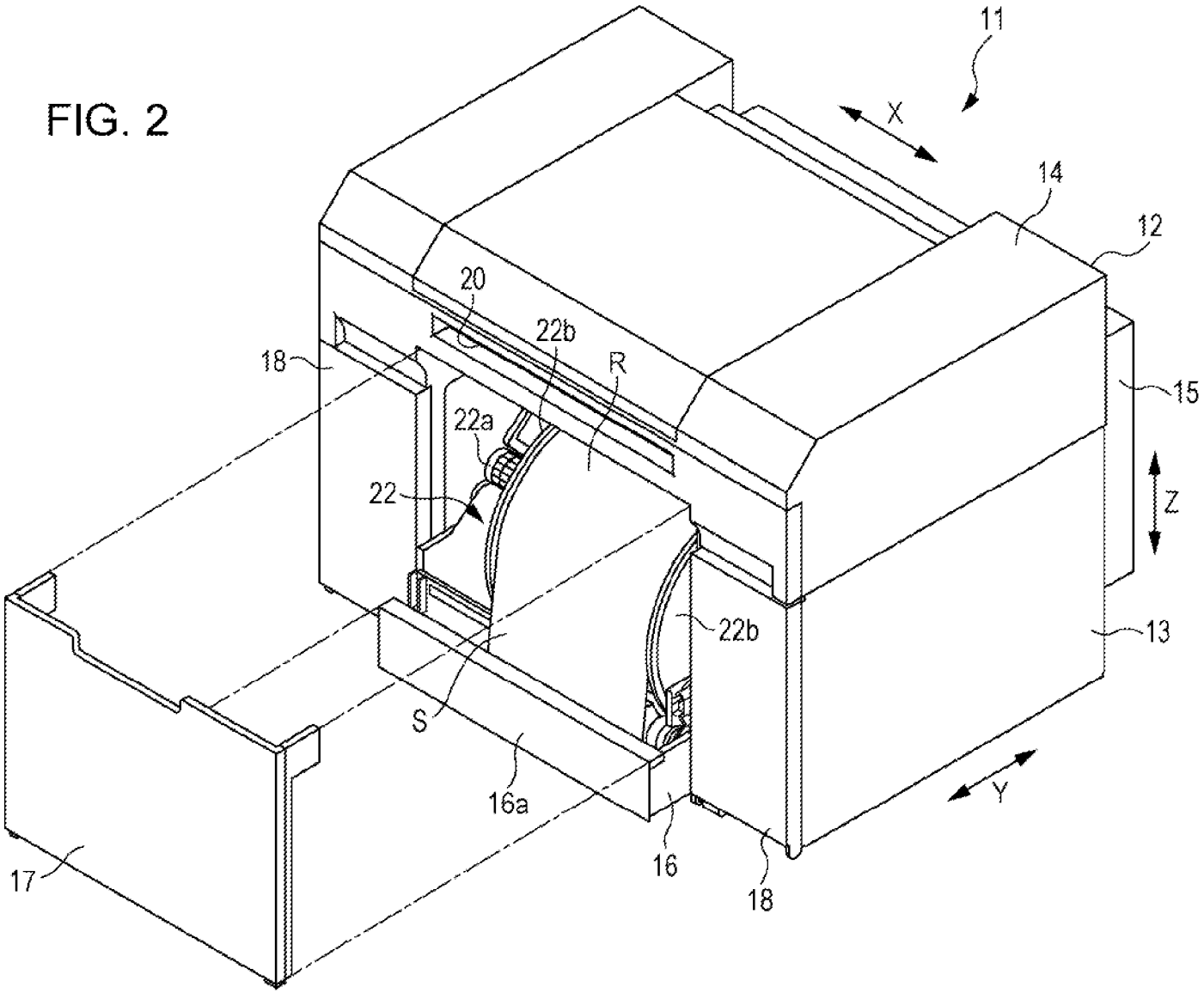
FIG. 2 is a perspective view illustrating the liquid ejecting apparatus from which a holding frame has been pulled out.

As illustrated in FIG. 2, a medium holding portion 22 is provided in the holding frame 16. The medium holding portion 22 holds a roll member R obtained by winding long paper S as an example of a medium into a cylindrical form in a superimposed manner. Note that a plurality of roll members R having different sizes can be loaded on the medium holding portion 22 in an exchangeable manner.

The medium holding portion 22 includes a support shaft 22*a* as an example of a support portion that supports the roll member R in a rotationally movable manner and a pair of flanges 22*b* that rotationally move integrally with the support shaft 22*a*. Of the flanges 22*b* that form the pair, the flange 22*b* at the first end side (the left side in FIG. 2) in the width direction X is capable of moving in the width direction X along the support shaft 22*a*.

When the roll member R is set on the medium holding portion 22, the front surface cover 17 is first detached from the case body unit 12 and the holding frame 16 is pulled to the front side from the case body unit 12, as illustrated in FIG. 2. Then, the roll member R is installed such that the support shaft 22*a* is inserted through the roll member R, and the flange 22*b* at the first end side is moved toward the second end side (to the right side in FIG. 1) so that the flanges 22*b* pinch both ends of the roll member R.

Note that in this embodiment, to transport the paper S from the medium holding portion 22 toward the second housing portion 14 is referred to as "feeding" and a transportation path of the paper S in the first housing portion 13 is referred to as a "feed path" in some cases.

Figure 3:
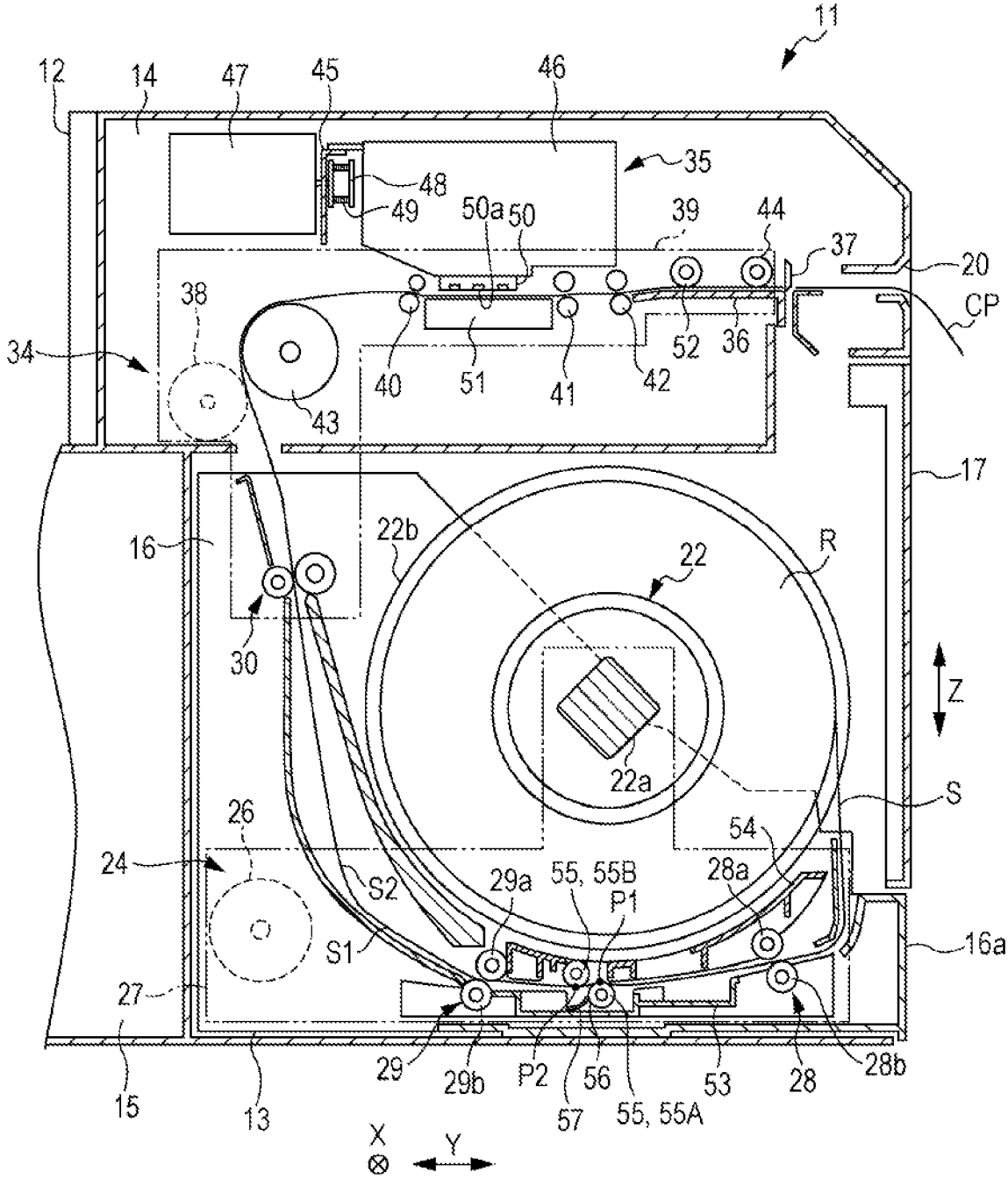
FIG. 3 is a cross-sectional view illustrating a schematic configuration of the liquid ejecting apparatus.

As illustrated in FIG. 3, a feed mechanism 24 for feeding the paper S toward the second housing portion 14 is held on the holding frame 16. The feed mechanism 24 includes a feed motor 26 as a driving source, a driving force transmission mechanism 27 for transmitting a driving force from the feed motor 26, and transportation roller pairs 28 and 29 that pinch and transport the paper S.

The transportation roller pair 28 is constituted by a driving roller 28*a* and a driven roller 28*b*. The driving roller 28*a* rotates with the driving force from the feed motor 26. The driven roller 28*b* forms a pair with the driving roller 28*a*. The transportation roller pair 29 is constituted by a driving roller 29*a* and a driven roller 29*b*. The driving roller 29*a* rotates with the driving force from the feed motor 26. The driven roller 29*b* forms a pair with the driving roller 29*a*. Further, the flanges 22*b* of the medium holding portion 22 rotate with the driving force from the feed motor 26.

A transportation mechanism 34, a recording unit 35, a heater 36, and a cutter 37 are housed in the second housing portion 14. The transportation mechanism 34 is a mechanism for transporting the paper S toward the discharge port 20. The recording unit 35 performs recording by ejecting ink onto the paper S that is transported by the transportation mechanism 34. The heater 36 is a unit for drying the paper S onto which ink adheres. The cutter 37 is a unit for cutting the paper S.

The transportation mechanism 34 includes a transport motor 38 as a driving source, a driving force transmission mechanism 39, transportation roller pairs 30, 40, 41, and 42, an intermediate roller 43, and a discharge roller 44. The driving force transmission mechanism 39 is a mechanism for transmitting a driving force from the transport motor 38. The transportation roller pairs 30, 40, 41, and 42 pinch and transport the paper S. The intermediate roller 43 rotates with the driving force from the transport motor 38. It is to be noted that the transportation roller pair 30 is arranged on the first housing portion 13.

The recording unit 35 includes a guide rail 45, a carriage 46, and a carriage motor 47. The guide rail 45 extends along the width direction X. The carriage 46 is held on the guide rail 45 so as to be capable of reciprocating in the width direction X. The carriage motor 47 serves as a driving source for moving the carriage 46 along the guide rail 45.

Furthermore, the recording unit 35 includes a pair of pulleys 48 (only one of which is illustrated in FIG. 3) arranged to be separated from each other by a predetermined distance in the width direction X and an endless timing belt 49 wound around the pair of pulleys 48. One of the pulleys 48 is coupled to an output shaft of the carriage motor 47. The carriage 46, which is fixed to a part of the timing belt 49, reciprocates along the guide rail 45 when the carriage motor 47 is driven forward and in reverse.

A liquid ejecting unit 50 capable of ejecting ink onto the paper S is held in a lower portion of the carriage 46. A plurality of liquid ejecting nozzles 50*a* are opened on the bottom surface of the liquid ejecting unit 50. Furthermore, a support member 51 for supporting the paper S is arranged below the carriage 46 along the transport path between the transportation roller pair 40 and the transportation roller pair 41.

The paper S on which recording (printing) has been performed by the recording unit 35 is transported along the upper surface of the plate-shaped heater 36 so as to be dried. Note that a pressure roller 52 for pressing the paper S and the discharge roller 44 are provided above the heater 36.

The paper S that has passed the upper portion of the heater 36 and has been dried is formed into a single sheet CP by cutting the portion on which recording has been performed so as to have a unit length by the cutter 37. The single sheet CP onto which recording has been completed is then discharged to the outside of the case body unit 12 through the discharge port 20.

A guide member 53 for guiding the fed paper S along a first surface S1 thereof and a guide portion 54 for guiding the paper S along a second surface S2 thereof are provided on the holding frame 16 at positions between the transportation roller pair 28 and the transportation roller pair 29 on the feed path (transportation path) of the paper S. Note that in this embodiment, the first surface S1 of the paper S is a front surface onto which ink is ejected, whereas the second surface S2 of the paper S is a rear surface onto which ink is not ejected.

Meanwhile, a plurality of (in this embodiment, two) removal rollers 55 (55A, 55B) are provided on the holding frame 16 at positions between the transportation roller pair 28 and the transportation roller pair 29 on the transportation path of the paper S. The removal rollers 55 (55A, 55B) are rollers for removing adhering objects that have adhered to the paper S, such as paper powder.

The removal rollers 55 rotate with a driving force from the feed motor 26 as an example of a driving source for rotating the driving rollers 28*a* and 29*a*. Note that the rotation speeds of the removal rollers 55 are set to be lower than the rotation speeds of the driving roller 28*a* and 29*a*.

Figure 4:
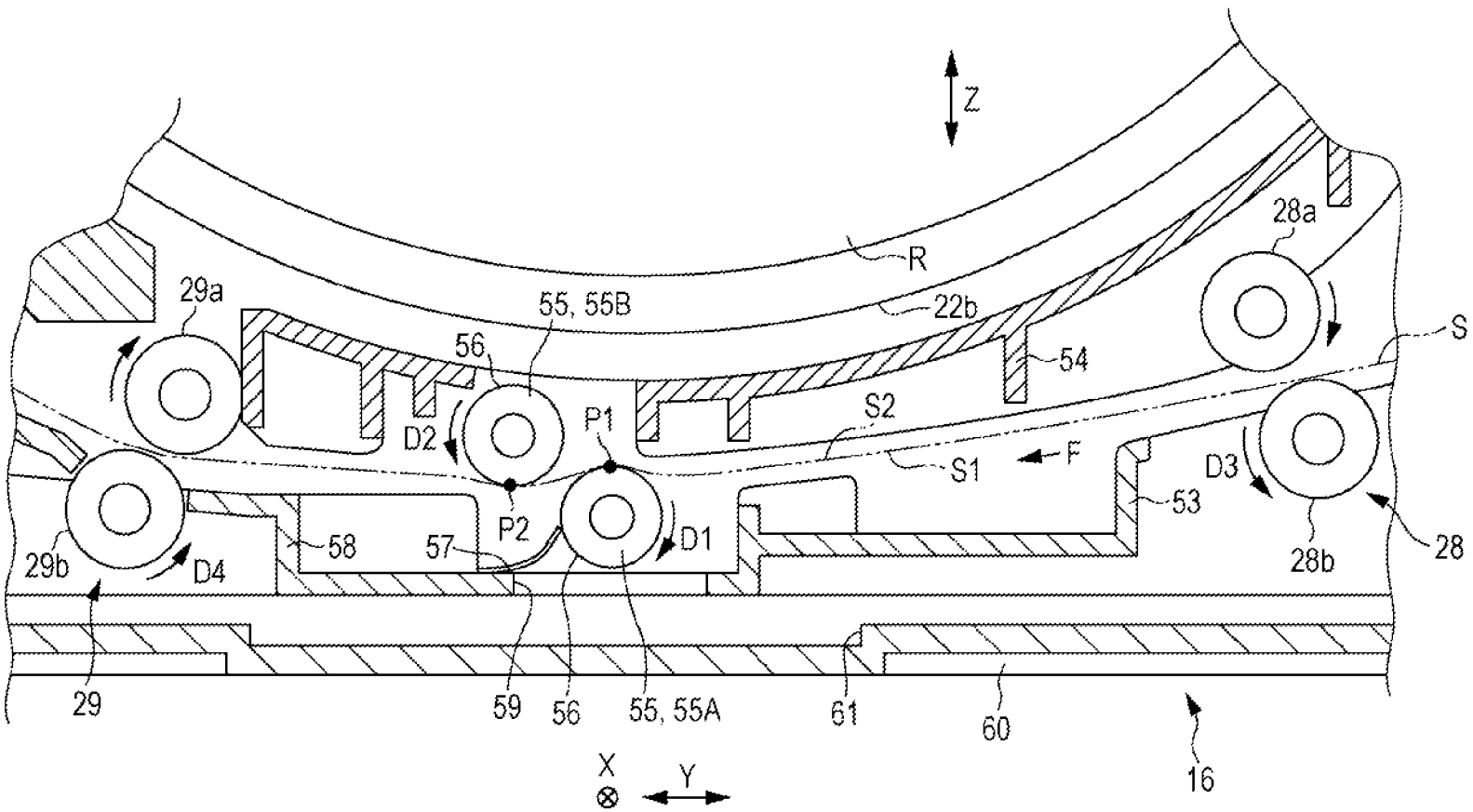
FIG. 4 is a cross-sectional view illustrating a configuration around removal rollers.

As illustrated in FIG. 4, the first removal roller 55A is arranged at the lower side of the transportation path and makes contact with the first surface S1 of the paper S that is transported at a first contact position P1. The first removal roller 55A rotates in a direction D1 (clockwise direction in FIG. 4) opposite to the transportation direction F of the paper S at the first contact position P1 so as to remove the adhering objects that have adhered to the paper S.

On the other hand, the second removal roller 55B is arranged at the upper side on the transportation path and makes contact with the second surface S2 of the paper S that is transported at a second contact position P2. The second removal roller 55B rotates in a direction D2 (counterclockwise direction in FIG. 4) opposite to the transportation direction F of the paper S at the second contact position P2 so as to remove the adhering objects that have adhered to the paper S.

The first removal roller 55A is arranged at the upstream side with respect to the second removal roller 55B in the transportation direction F. In other words, the first contact position P1 and the second contact position P2 are separated from each other in the transportation direction F. Note that the paper S is transported in a state where the first surface S1 as a printing surface onto which ink is ejected faces downward at the first contact position P1 and the second contact position P2.

Further, the upper end portion of the first removal roller 55A is arranged at the upper side with respect to the lower end portion of the second removal roller 55B in the vertical direction Z. Further, the first contact position P1 is arranged at a position slightly higher than the transportation path at the upstream side thereof in the transportation direction in the vertical direction Z. The second contact position P2 is arranged at a position slightly lower than the transportation path at the downstream side thereof in the transportation direction and the first contact position P1 in the vertical direction Z.

A sheet-like removal member 57 is arranged at the downstream side with respect to the first removal roller 55A arranged at the lower side of the transportation path in the transportation direction. The removal member 57 removes the adhering objects that have adhered to an outer circumferential surface 56 of the first removal roller 55A while making contact with the outer circumferential surface 56.

A first receptacle unit 58 is provided at the lower side of the removal rollers 55. The first receptacle unit 58 is an example of a receptacle unit for receiving the adhering objects that have been removed from the paper S, have adhered to the outer circumferential surface 56 of the first removal rollers 55, and then, have dropped from the removal rollers 55. Note that the first receptacle unit 58 is provided on the guide member 53 in a recessed manner. The first receptacle unit 58 is provided at a position from the upstream side of the first removal roller 55A to the downstream side of the second removal roller 55B in the transportation direction F.

A through-hole 59 is formed on the guide member 53 at a position corresponding to the end portion of the paper S in the width direction X. To be more specific, the through-hole 59 is formed at a position that is lower side of the first removal roller 55A and the removal member 57. Further, a bottom plate portion 60 is provided on the bottom of the holding frame 16. A second receptacle unit 61 is provided on the bottom plate portion 60 at a position that is lower side of the through-hole 59 in a recessed form. The second receptacle unit 61 is a unit for receiving the adhering objects that have been removed from the first removal roller 55A by the removal member 57.

Contact areas of the removal rollers 55 with the paper S are larger as the outer diameters thereof are larger, so that removal amounts of the adhering objects thereby are large. However, if the outer diameters of the removal rollers 55 are made larger, the apparatus is increased in size. Further, if the rotation speeds of the removal rollers 55 are made higher, an effect that the removal rollers 55 scrape off the adhering objects is enhanced. However, if the rotation speeds of the removal rollers 55 are made too high, transportation of the paper S is inhibited. Based on this, when one removal roller 55 of the plurality of removal rollers 55 having different outer diameters is selected to be used, the rotation speed of the removal roller 55 is set to be lower as the outer diameter thereof is larger.

Next, described are actions of the liquid ejecting apparatus 11 configured as described above.

As illustrated in FIG. 4, the first removal roller 55A rotates in the direction D1 opposite to the transportation direction F in a state of making contact with the first surface S1 of the paper S that is transported at the first contact position P1. With this, the first removal roller 55A removes the adhering objects that have adhered to the paper S in a scraping manner. On the other hand, the second removal roller 55B rotates in the direction D2 opposite to the transportation direction F in a state of making contact with the second surface S2 of the paper S that is transported at the second contact position P2. With this, the second removal roller 55B removes the adhering objects that have adhered to the paper S in a scraping manner.

Here, "paper powder" refers to pieces of fiber that forms the paper S, powder from materials contained in or applied to the paper S, and so on. For example, the paper S may contain or be coated with calcium carbonate as a whitening pigment, kaolin or the like for exhibiting glossiness, and so on. If, for example, calcium carbonate or the like enters into the liquid ejecting nozzles 50*a*, viscosity of the ink in the liquid ejecting nozzles 50*a* is increased significantly, leading to a risk of severe clogging that is difficult to be eliminated.

With respect to this point, in this embodiment, the paper powder is removed not only from the first surface S1 of the paper S, which corresponds to the printing surface, but also from the second surface S2. This suppresses entrance of the paper powder into the periphery of the liquid ejecting unit 50 along with the paper S, which suppresses the clogging of the liquid ejecting nozzles 50*a* as a result.

The driving roller 28*a* rotates in a direction D3 (counterclockwise direction in FIG. 4) for transporting the paper S in the transportation direction F when the removal rollers 55 rotate. Further, the driving roller 29*a* rotates in a direction D4 (counterclockwise direction in FIG. 4) for transporting the paper S in the transportation direction F.

That is to say, the first removal roller 55A rotates in the opposite direction to that of the driving rollers 28*a* and 29*a*. The driving rollers 28*a* and 29*a* are provided such that the first contact position P1 and the second contact position P2 are located therebetween in the transportation direction F. Further, the rotation speeds of the removal rollers 55 are lower than the rotation speeds of the driving rollers 28*a* and 29*a*, so that the paper S is transported in the transportation direction F.

Further, when the first contact position P1 and the second contact position P2 are located at the same position in the transportation direction F, the first removal roller 55A and the second removal roller 55B pinch the paper S. In this case, there arises risks that the transportation of the paper S is inhibited and the paper S is wrapped around the removal rollers 55. However, in this embodiment, the first contact position P1 and the second contact position P2 are separated from each other in the transportation direction F so as to reduce the risks.

Further, the first receptacle unit 58 is provided to extend from the position at the upstream side with respect to the first removal roller 55A to the position at the downstream side with respect to the second removal roller 55B in the transportation direction F. Therefore, the adhering objects that have stripped off from the outer circumferential surfaces 56 thereof with the rotation of the removal rollers 55 are received by the first receptacle unit 58. It is to be noted that although the adhering objects are also stripped off from the second removal roller 55B after the rear end of the paper S has passed therethrough in some cases, the adhering objects are also received by the first receptacle unit 58.

The paper S is transported in a state where the first surface S1 onto which ink is ejected faces downward at the first contact position P1. The removal member 57 is arranged at the downstream side of the first removal roller 55A arranged at the lower side of the paper S that is transported in the transportation direction. Further, the removal member 57 makes contact with the outer circumferential surface 56 of the first removal roller 55A. Therefore, if the first removal roller 55A rotates, the adhering objects are scraped off from the outer circumferential surface 56 thereof by the removal member 57. Then, a part of the adhering objects that have been scraped off from the outer circumferential surface 56 of the first removal roller 55A drop to the second receptacle unit 61 through the through-hole 59 provided on the guide member 53.

That is to say, the adhering objects that strip off from the outer circumferential surfaces 56 of the removal rollers 55 naturally are held on the first receptacle unit 58 arranged at the lower side of the transportation path. Meanwhile, much paper powder and the like adhere to the end portions of the paper S. Therefore, there arises a risk that many adhering objects scraped off by the removal member 57 deposit at the lower side thereof. Therefore, the adhering objects that have dropped from the vicinity of positions corresponding to the end portions of the paper S in the width direction X among the adhering objects removed from the first removal roller 55A are held on the second receptacle unit 61 arranged at the outer side of the transportation path.

When the outer diameters of the removal rollers 55 are changed, the rotation speeds of the removal rollers 55 are set to be lower as the outer diameters thereof are larger. Therefore, when the removal rollers 55 having different outer diameters are used, a removal amount of the adhering objects is kept to be equal to or larger than a constant amount.

In this embodiment, the upper end portion of the first removal roller 55A is arranged at the upper side with respect to the lower end portion of the second removal roller 55B in the vertical direction Z. Further, the first contact position P1 is arranged at a position slightly higher than the transportation path at the upstream side thereof in the transportation direction in the vertical direction Z. On the other hand, the second contact position P2 is arranged at a position slightly lower than the transportation path at the downstream side thereof in the transportation direction and the first contact position P1 in the vertical direction Z. Therefore, the paper S is made into a state of being curved along the outer circumferential surfaces of the removal rollers 55 and the contact areas of the paper S with the removal rollers 55 are larger. Accordingly, the adhering objects are removed reliably.

According to the embodiment described thus far, the following effects can be achieved.

1. The removal rollers 55 rotate in the rotating direction opposite to the transportation direction F while making contact with the paper S so as to remove the adhering objects which have adhered to the paper S in a scraping manner effectively. Further, the first removal roller 55A makes contact with the first surface S1 of the paper S while the second removal roller 55B makes contact with the second surface S2 of the paper S. Therefore, the adhering objects that have adhered to the end portions of the paper S can be removed effectively. Accordingly, the adhering objects that have adhered to the end portions and the like of the paper S onto which ink is ejected can be removed.

2. If two removal rollers 55 rotate in a state of pinching the paper S, there arises risks that transportation of the paper S is inhibited and the paper S is wrapped around the removal rollers 55. However, the first contact position P1 and the second position P2 are separated from each other in the transportation direction F of the paper S so as to reduce the risks.

3. The adhering objects that have adhered to the first removal roller 55A are removed by the removal member 57. This suppress problems that removal capability of the first removal roller 55A is lowered and the adhering objects which have adhered to the first removal roller 55A join together and adhere to the paper S.

4. The paper S is transported in a state where the first surface S1 faces downward at the first contact position P1 and the removal member 57 is arranged at the downstream side with respect to the first removal roller 55A in the transportation direction. Therefore, adherence of the adhering objects that have been removed from the first removal roller 55A to the paper S and the second removal roller 55B can be suppressed.

5. The adhering objects that have been removed from the paper S are held on the first receptacle unit 58 and the second receptacle unit 61. Therefore, scattering of the adhering objects removed from the paper S to the periphery can be suppressed.

6. The removal rollers 55 rotate with a driving force from the feed motor 26 same as the driving rollers 28*a* and 29*a*. Therefore, another driving source for rotating the removal rollers 55 is not needed to be provided.

7. The driving roller 28*a* is provided at a position at the upstream side with respect to the first contact position P1 in the transportation direction and the driving roller 29*a* is provided at a position at the downstream side with respect to the second contact position P2 in the transportation direction. Accordingly, even when the removal rollers 55 rotate in the opposite direction to that of the driving rollers 28*a* and 29*a*, the paper can be transported in the transportation direction F. Further, the rotation speeds of the removal rollers 55 are lower than the rotation speeds of the driving rollers 28*a* and 29*a*. Therefore, even when the removal rollers 55 rotate in the opposite direction to that of the driving rollers 28*a* and 29*a*, the paper can be transported in the transportation direction F.

8. When the outer diameters of the removal rollers 55 are small, the rotation speeds of the removal rollers 55 are made high so as to enhance a scraping effect of the adhering objects. On the other hand, when the rotation speeds of the removal rollers 55 are low, the outer diameters of the removal rollers 55 are made large so as to increase contact areas thereof with the paper S. This makes it possible to remove the adhering objects reliably.

Note that the aforementioned embodiment may be modified as described hereinafter.

Equal to or more than three removal rollers 55 may be provided along the transportation direction F of the paper S.

Outer diameters and rotation speeds of the plurality of removal rollers 55 may be different. For example, if the outer diameter of the first removal roller 55A is made larger than that of the second removal roller 55B or the rotation speed of the first removal roller 55A is made lower than that of the second removal roller 55B, the contact area of the first removal roller 55A with the first surface S1 of the paper S (printing surface) is increased. Therefore, the adhering objects on the printing surface of the paper S can be removed more reliably.

The removal rollers 55 may be provided at positions corresponding to end portions of the paper S in the width direction X only. Alternatively, the removal rollers 55 may be provided over the entire width of the paper S in the width direction X. Further, a plurality of removal rollers 55 of different types may be arranged in the width direction X. For example, the removal rollers 55 having a high removal capability may be provided at positions corresponding to the end portions of the paper S in the width direction X.

A roll-like member or a brush-like member may be provided as the removal member 57.

The removal rollers 55 may be provided in the second housing portion 14.

The removal member 57 may be arranged at the lower side of the removal rollers 55.

The removal member 57 may be arranged at a position corresponding to an end portion of the paper S in the width direction X.

The removal member 57 may not be provided.

The removal rollers 55 may make contact with the paper S that is transported along the vertical direction Z. In this case, a removal member that makes contact with the outer circumferential surface 56 of the second removal roller 55B may be further provided.

The through-hole 59 provided on the guide member 53 may be configured as a long-hole extending in the width direction X.

The first receptacle unit 58 is not limited to be provided on the guide member 53 in the recessed form. Further, the second receptacle unit 61 is not limited to be provided on the bottom plate portion 60 of the holding frame 16 in the recessed form. For example, a receptacle member that forms the first receptacle unit 58 and the second receptacle unit 61 may be provided additionally.

The first receptacle unit 58 may not be provided.

The through-hole 59 and the second receptacle unit 61 may not be provided.

An additional transportation roller may be arranged between the first contact position P1 and the second contact position P2 in the transportation direction F.

The removal rollers 55 may be made to rotate with a driving force from a driving source that is different from that of the driving rollers 28*a* and 29*a*.

A configuration in which the first contact position P1 and the second contact position P2 are arranged at the same position in the transportation direction F and the first removal roller 55A and the second removal roller 55B nip the paper S may be employed.

The medium is not limited to paper, and may be a plastic film, a board member, or the like. Alternatively, the medium may be a fabric used in textile printing devices.

In the aforementioned embodiment, a liquid ejecting apparatus that ejects and discharges liquid aside from ink may be employed as the liquid ejecting apparatus. Note that the state of the liquid that is discharged from the liquid ejecting apparatus as extremely fine droplets is intended to include granule forms, teardrop forms, and forms that pull tails in a string-like form therebehind. Furthermore, the "liquid" referred herein can be any material capable of being ejected by the liquid ejecting apparatus. For example, any matter can be used as long as the matter is in its liquid state, including liquid having high or low viscosity, sol, gel water, other inorganic solvents, organic solvents, solutions, liquid resins, and fluid states such as liquid metals (metallic melts). Furthermore, in addition to liquids as a single state of a matter, liquids in which the particles of a functional material composed of a solid matter such as pigments, metal particles, or the like are dissolved, dispersed, or mixed in solvents are included as well. Ink, as described in the above embodiment, liquid crystals, and the like can be given as representative examples of the liquid. Here, "ink" generally includes water-based and oil-based inks, as well as various types of liquid compositions, including gel inks, hot-melt inks, and so on. Liquid ejecting apparatuses that eject liquids including materials such as electrode materials, coloring materials, and so on in a dispersed or dissolved state for use in the manufacture and so on of, for example, liquid-crystal displays, EL (electroluminescence) displays, surface emitting displays, and color filters can be given as specific examples of liquid ejecting apparatuses. Alternatively, the liquid ejecting apparatus may be a liquid ejecting apparatus that ejects bioorganic matters used in the manufacture of biochips, a liquid ejecting apparatus that is used as a precision pipette and ejects liquids to be used as samples, textile printing equipment, a microdispenser, and so on. Furthermore, the invention may be employed in liquid ejecting apparatuses that perform pinpoint ejection of lubrication oils into the precision mechanisms of clocks, cameras, and the like, as well as in liquid ejecting apparatuses that eject transparent resin liquids such as ultraviolet curing resins onto a substrate in order to form miniature hemispheric lenses (optical lenses) for use in optical communication elements. The invention may also be employed in a liquid ejecting apparatus that ejects an etching liquid such as an acid or alkali onto a substrate or the like for etching.

The entire disclosure of Japanese Patent Application No. 2012-220989, filed Oct. 3, 2012 is expressly incorporated by reference herein.

What is claimed is:

1. A liquid ejecting apparatus comprising:

a liquid ejecting unit that ejects liquid onto a medium;

a first removal roller that rotates in a direction opposite to a transportation direction of the medium at a first contact position in a state of being contact with a first surface of the medium that is transported at the first contact position so as to remove adhering objects which have adhered to the medium; and a second removal roller that rotates in the direction opposite to the transportation direction of the medium at a second contact position in a state of being contact with a second surface of the medium that is transported at the second contact position so as to remove adhering objects which have adhered to the medium, wherein the first contact point is higher than a portion of a transportation path at an upstream side of the transportation path adjacent to the first removal roller and the second contact point is lower than a portion of the transportation path at a downstream side of the transportation path adjacent to the second removal roller.

2. The liquid ejecting apparatus according to claim 1, wherein the first contact position and the second position are separated from each other in the transportation direction.

3. The liquid ejecting apparatus according to claim 1, further comprising a removal member that makes contact with an outer circumferential surface of at least one of the first removal roller and the second removal roller so as to remove adhering objects which have adhered to the outer circumferential surface.

4. The liquid ejecting apparatus according to claim 3, wherein the medium is transported in a state where the first surface onto which liquid is ejected faces downward and the first removal roller is arranged at a lower side of a transportation path of the medium at the first contact position, and the removal member is arranged at a downstream side with respect to the first removal roller in the transportation direction.

5. The liquid ejecting apparatus according to claim 1, wherein a receptacle unit for receiving adhering objects removed from the medium is provided at a lower side of at least one of the first removal roller and the second removal roller.

6. The liquid ejecting apparatus according to claim 1, further comprising:

driving rollers for transporting the medium; and a driving source for rotating the first removal roller, the second removal roller and the driving roller.

7. The liquid ejecting apparatus according to claim 6, wherein each of the driving rollers is provided at a position at an upstream side with respect to the first contact position in the transportation direction and a position at a downstream side with respect to the second contact position in the transportation direction respectively, and a rotation speed of at least one of the first removal roller and the second removal roller is lower than a rotation speed of the driving roller.

8. The liquid ejecting apparatus according to claim 1, wherein an outer diameter of the first removal roller is different from an outer diameter of the second removal roller.

* * * * *